US005743201A

United States Patent [19]

Card et al.

[11] Patent Number: 5,743,201

[45] Date of Patent: *Apr. 28, 1998

[54] TUFTING MACHINE PATTERN YARN FEED MECHANISM

[75] Inventors: Roy T. Card, Chattanooga, Tenn.; Wilton Hall, Oglethorpe, Ga.; Marshall Allen Neely, Soddy Daisy; Michael L. Kilgore, Whitwell, both of Tenn.

[73] Assignee: Card-Monroe Corp., Chattanooga, Tenn.

[ * ] Notice: The term of this patent shall not extend beyond the expiration date of Pat. No. 5,622,126.

[21] Appl. No.: 843,559

[22] Filed: Apr. 18, 1997

Related U.S. Application Data

[63] Continuation-in-part of Ser. No. 376,345, Jan. 23, 1995, Pat. No. 5,622,125.

[51] Int. Cl.[6] ..... D05C 15/18

[52] U.S. Cl. ..... 112/80.73

[58] Field of Search ..... 112/80.73, 80.7, 112/80.01, 302

[56] References Cited

U.S. PATENT DOCUMENTS

| | | | |
|---|---|---|---|
| 2,880,684 | 4/1959 | Masland 2nd . | |
| 3,134,529 | 5/1964 | Beasley . | |
| 4,411,207 | 10/1983 | Brock et al. . | |
| 4,856,411 | 8/1989 | Kurata | 112/80.73 |
| 4,864,946 | 9/1989 | Watkins | 112/80.73 |
| 5,182,997 | 2/1993 | Bardsley | 112/80.73 |
| 5,622,126 | 4/1997 | Card et al. | 112/80.73 |

*Primary Examiner*—Paul C. Lewis
*Attorney, Agent, or Firm*—Isaf, Vaughan & Kerr

[57] ABSTRACT

A yarn feed mechanism for use with a tufting machine is disclosed. The tufting machine has a needle bar with an aligned series of spaced tufting needles disposed thereon, each of which is supplied with yarn from a yarn supply for penetrating a backing material to sew tufts of yarn therein. The yarn feed mechanism includes a support framework mounted on the tufting machine adjacent a yarn feed path extending from the yarn supply to the needles of the tufting machine, with at least one yarn feed roll assembly mounted for rotation on the support framework. The yarn feed roll assembly further includes an elongate yarn feed roll having an exterior yarn driving periphery extending along a longitudinal axis parallel to the needle bar of the tufting machine, the yarn feed roll being rotated in timed relationship with the reciprocation of the needle bar. An orbital yarn applying member spaced from the yarn feed roll is supported on the support framework and is movable about the yarn feed roll in an orbital path from a yarn receiving position to a yarn applying position. The yarn applying member is used to apply portions of selected yarns against at least a portion of the yarn driving periphery of the yarn feed roll in the yarn applying position for controlling the rate at which the yarn is fed to the needles of the tufting machine. The yarn applying member of the invention may comprise at least one concentrically orbited control rod spaced from and parallel to the yarn feed roll, or may comprise a pinch roller orbited eccentrically about the yarn feed roll, and constructed to be moved into a yarn applying position engaged with the periphery of the yarn feed roll.

30 Claims, 10 Drawing Sheets

TUFTING MACHINE PATTERN YARN FEED MECHANISM

CROSS REFERENCE TO RELATED APPLICATION

This application is a continuation-in-part of U.S. patent application Ser. No. 08/376,345, now U.S. Pat. No. 5,622,125 , entitled Tufting Machine Yarn Feed Mechanism, filed in the United States Patent and Trademark Office on Jan. 23, 1995.

FIELD OF INVENTION

This invention relates to tufting machines. More particularly, the invention relates to an improved tufting machine pattern yarn feed mechanism used to feed yarns to a tufting machine for manufacturing patterned tufted articles, and to a process of using such a yarn feed mechanism.

BACKGROUND OF THE INVENTION

The use of roll type pattern yarn feed attachments, also known as scroll attachments for use in feeding yarns to the needles of a tufting machine according to prescribed patterns in order to create patterned tufted articles is well known. Such a roll type yarn feed mechanism controls the rate at which prescribed yarns are fed to selected needles passed reciprocably through a backing material being advanced underneath the needles of the tufting machine. This rate of yarn feed in turn controls the pile height of the tufts, usually by causing certain of the yarns to be "back robbed" from the previously sewn loops in the backing material so that a full pile height is not attained relative to the height of surrounding full height piles.

In the past it has usually been necessary, when a yarn breaks or when different yarns are to be fed to different needles during pattern changeover, to re-wrap such a yarn, or yarns, around the appropriate yarn drive roll, or rolls, and then re-thread the needles. The threading/re-threading of the needles can be quite a laborious and time intensive process as each yarn must be separately wrapped around the appropriate yarn drive roll, and then threaded or re-threaded through respective ones of the needles thereafter. This has typically occurred each time there was a change of yarn sequence, i.e. the pattern, of the yarns across the width of the machine.

Moreover, as tufting machine operating speeds have increased due to improvements in machine design, construction, and control, more precise control of the yarns, as well as improved feeding mechanisms for feeding the yarns to the needles at increased rates of speed matching the increased speed of the tufting machine, are required in order to provide for increased operating efficiency in producing a high quality tufted article, but yet which still allows for precise control of yarn feed rates when creating patterned tufted articles.

What is needed, therefore, but seemingly unavailable in the art, is an improved tufting machine yarn feed mechanism that provides for increased yarn feed speeds and which also allows for a high degree of precision in the control of the feed rates of the yarns to the needles of the tufting machine. Moreover, an improved, more serviceable, tufting machine yarn feed mechanism is needed with which a tufting machine operator can readily change the sequence of yarns across the width of the tufting machine, and do so while standing on the floor of the mill, or on a work platform positioned with respect to the tufting machine without requiring the use of additional staging platforms or ladders to reach the yarn feed mechanism. What is also needed is an improved tufting machine yarn feed device which dispenses with the necessity of cutting the yarns for the purpose of changing to a different yarn feed roll, i.e. changing to a new pattern, as well as dispensing with the necessity of re-threading the yarns about the yarn feed rolls during pattern changeover, and which also eliminates the necessity of manually wrapping individual yarns around a yarn feed roll in order to provide for the feed of the yarn by that feed roll. Lastly, what is needed is an improved tufting machine yarn feed mechanism that allows for the amount of yarn wrap around the yarn feed rolls to be quickly and easily varied as desired or needed for the tufted articles being produced.

SUMMARY OF THE INVENTION

The present invention provides an improved tufting machine yarn feed mechanism which overcomes some of the design deficiencies of other yarn feed mechanisms known in the art, and which represents a significant advance in the art. The improved tufting machine yarn feed mechanism of this invention enables intermediate portions of desired yarns to be selected, after having been first threaded through the needles of the tufting machine, and moved against and selectively about any selected yarn feed roll, thereby eliminating the necessity of first wrapping the yarns around the yarn feed roll, and then re-threading the needles when pattern changes in the tufted article are made. This materially reduces the time required to make a change in yarn sequence across the width of the tufting machine, and also eliminates the need for cutting each end of the yarns when changing from one yarn feed roll to another.

The present invention includes a conventional tufting machine with a spaced series of needles carried by one or more needle bars being reciprocated toward and away from a backing material being passed transversely thereunder and through a tufting zone defined on the tufting machine, the tufting machine having a plurality of parallel yarn feed rolls or rolls disposed adjacent the path of travel of the yarns. In a first embodiment of the invention, each yarn feed roll has a plurality of elongate, circumferentially spaced, parallel, and orbitally movable yarn control rods carried at their ends by opposed pairs of radially extending indexing plates or discs. The indexing plates or discs are concentrically mounted with respect to their associated yarn feed roll for permitting the control rods to be selectively and incrementally indexed about the yarn feed roll to selected positions for applying the yarns to a portion of the periphery of the associated yarn feed roll.

Each control rod has, at its respective ends, a locking mechanism which includes a spring loaded telescoping detent plug, the distal end of which protrudes from the end of the rod for being received in one of the sockets of pairs of opposed sockets mounted on the opposed indexing plates, whereby a selected control rod can be readily installed and removed therefrom. Yieldable detents enable the indexing plates to be readily rotated to selected angular positions where selected ones of the yarns are partially wrapped around the selected yarn feed roll.

Preferably, the control rods are arranged in circumferentially spaced parallel relationship with respect to one another and to the yarn feed roll with which the control rods are associated. Thus the control rods are spaced apart approximately 90° from each other on the indexing plates for circumscribing approximately 270° of the periphery of each yarn feed roll. The control rods are spaced from the periphery of their associated yarn feed roll, and are constructed and arranged to hold intermediate portions of selected yarns out of engagement with the periphery of their associated yarn feed roll while applying other intermediate portions of the same yarns to the periphery of the yarn feed roll for partially circumscribing and engaging the peripheral surface of the yarn feed roll for feeding the yarns to the tufting needles.

The improved yarn feed mechanism of the present invention includes a plurality of yarn feed rolls arrayed in a spaced series extending away from the frame of the tufting machine and along an arcuate or straight line, as desired, and supported thereon at a position at which machine operators can conveniently gain access to the yarn feed rolls, the control rods, and the yarns being fed by the yarn feed mechanism for greatly decreasing the amount of time needed for yarn handling during pattern changeover, as well as for improved machine serviceability. Each yarn feed roll is individually driven by a separate servomotor, although other suitable drive mechanisms may be used in lieu of servomotors to include conventional AC and/or DC electric motors used with gear reducers, for example. The servomotors may in turn be controlled by separate control processors, or by a common control processor, typically a computer, as desired, in which the common control processor may also be adapted to control some or all of the operations performed by the tufting machine so as to synchronize the yarn feed with the reciprocation of the needles through the tufting zone as well as the feed of the backing material transversely therethrough.

In another embodiment of the invention, an elongate pinch roller is used in lieu of at least one control rod, and more preferably in place of all of the control rods, to not only wrap the yarn about at least a portion of the periphery of the appropriate yarn feed roll, but also to more positively control the rate of yarn feed during the tufting of the desired pattern in the article by pinching the yarn with the pinch roller against at least a portion of the periphery of the yarn feed roll. In fashion similar to the first embodiment of the invention using yarn control rods, the pinch roller is constructed to be quickly and easily removed from a pair of spaced, radially extending, and opposed indexing plates positioned at the opposite ends of the yarn feed roll and the pinch roller and on which the pinch roller and yarn feed roll are supported for allowing a machine operator to pass the pinch roller underneath selected ones of the yarns during pattern changeover, and to then replace the pinch roller on its indexing plates with the selected ones of the yarns passing between the pinch roller and its associated yarn feed roll. Moreover, and as with the control rods of the first embodiment of the invention, the pinch roller at first does not wrap the selected yarns about the periphery of the yarn feed roll until such time as the pinch roller is orbitally and eccentrically rotated about the yarn feed roll on its indexing plates to move the selected yarns into engagement with at least a portion of the periphery of the yarn drive roll, the pinch roller being constructed to move into engagement with a portion of the periphery of the yarn feed roll as the angular degree of yarn wrap about the yarn feed roll reaches a predetermined wrap angle, whereupon the pinch roller not only wraps the yarn, or yarns, at least partially about the periphery of the yarn feed roll, the pinch roller also pinches these yarns against the yarn feed roll to positively control the feed rate of the yarns to the appropriate tufting needles.

Accordingly, it is an object of the present invention to provide a quick change yarn feed mechanism for a tufting machine which will permit intermediate portions of selected yarns to be at least partially wrapped about selected yarn feed rolls without the necessity of re-threading or manually wrapping the yarns around the yarn feed rolls, or re-threading the needles of the tufting machine.

Another object of the present invention is to provide an improved yarn feed mechanism which enables selected yarns to be easily placed in contact with a prescribed yarn feed roll for being fed at a prescribed rate thereby, and which can be readily and easily changed to contacting another feed roll capable of feeding the yarn at a different feed rate.

Other objects, features and advantages of the present invention will become apparent from the following description, considered in conjunction with the accompanying drawings wherein like character references designate corresponding parts throughout the several views.

DETAILED DESCRIPTION OF THE PREFERRED EMBODIMENTS

Figure 1:
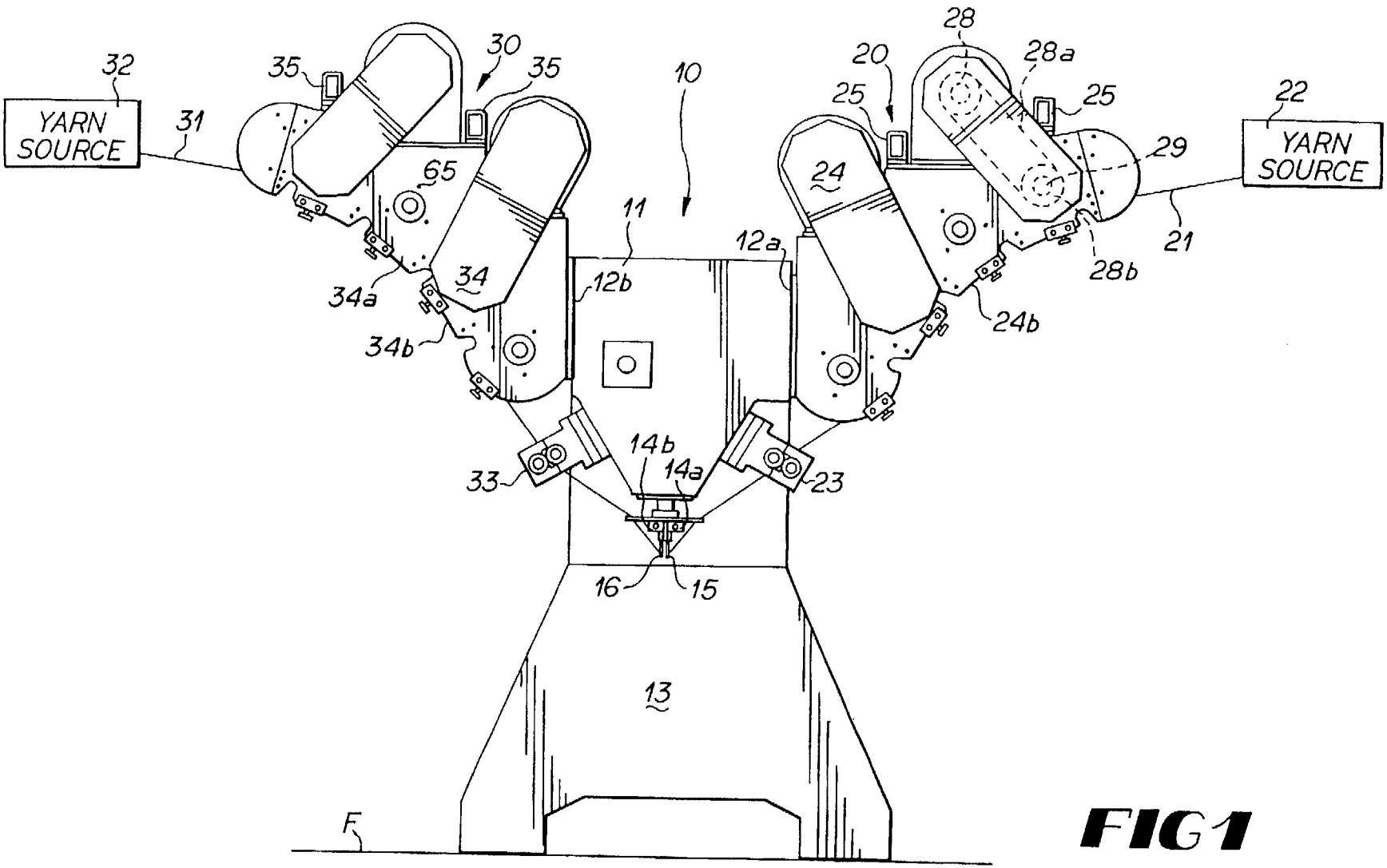
FIG. 1 is a schematic side elevational view of a conventional tufting machine having separate front and rear quick change yarn feed mechanisms constructed in accordance with the present invention.

Referring now in detail to the drawings, in which like reference characters indicate like parts throughout the several views, numeral 10 of FIG. 1 denotes generally a known tufting machine having a head 11 supported on a pair of front and rear opposed, vertically disposed, side plates 12*a* and 12*b*, so that head 11 is supported on a base 13. Tufting machine 10 also includes two reciprocable needle bars 14*a* and 14*b*, each of which carries a spaced series of tufting needles 15 and 16, respectively, along the length of the respective needle bars. In known fashion, the needle bars may be laterally shiftable with respect to one another, and are constructed and arranged to be reciprocably moved toward and away from a tufting zone (not illustrated) defined beneath the two rows of needles 15,16 and through which a backing material (not illustrated) is transversely passed so that needles 15,16 reciprocably pass through the backing material to create tufts of yarn thereon.

A rear yarn feed mechanism 20, also referred to as a yarn pattern attachment, is illustrated in FIG. 1 having two or more transversely spaced, vertically disposed, and opposed support brackets 24 which extend upwardly and rearwardly from plate 12*a* of head 11. Spaced parallel, transverse beams or cross bars 25 extend between brackets 24 and join the upper portions of the brackets to one another to create a structurally rigid load carrying framework for the yarn feed mechanism.

Rear yarn feed mechanism 20 of FIG. 1 feeds a plurality of rear yarns 21 in an inwardly and downwardly direction from a rear yarn source 22, schematically illustrated in FIG. 1, via the yarn feed mechanism 20, in conjunction with a yarn puller 23, the yarn puller having a pair of spaced counter-rotating yarn puller rollers, toward the needles 15 of needle bar 14*a*.

In like fashion, the front plate 12*b* supports a front yarn feed mechanism 30, or pattern attachment, which is complimentary to rear yarn feed mechanism 20, except that it is mounted on front plate 12*b* in opposite hand, as best shown in FIG. 1. Front yarn feed mechanism 30 includes two or more transversely spaced, vertically disposed, and opposed support brackets 34 which extend upwardly and forwardly from plate 12*b* of head 11, with a plurality of transverse beams or cross bars 35 extending therebetween and joining the upper edges of brackets 34 together to form a rigid frame assembly for supporting front yarn feed mechanism 30. These two frame assemblies, respectively, support the rear and front yarn feed mechanisms on the tufting machine with respect to needle bars 14*a*, 14*b*, and are constructed so as to position the yarn feed mechanism at a convenient working height for machine operators, so they may easily change the yarn feed sequence (pattern) as described in greater detail, below, and so that machine service technicians can gain ready access to the components of the yarn feed mechanisms for service and repair.

Moreover, it is understood by those skilled in the art that although two needle bars 14*a* and 14*b* are illustrated in FIG. 1, only one such needle bar need be present and thus only one of yarn feed mechanisms 20, 30 need be provided. Therefore, as rear yarn feed mechanism 20 is identical to front yarn feed mechanism 30, with the noted exception of being in opposite hand, the remainder of this description will be devoted primarily to front yarn feed mechanism 30, it being understood that similar components are contained in rear yarn feed mechanism 20.

Figure 2:
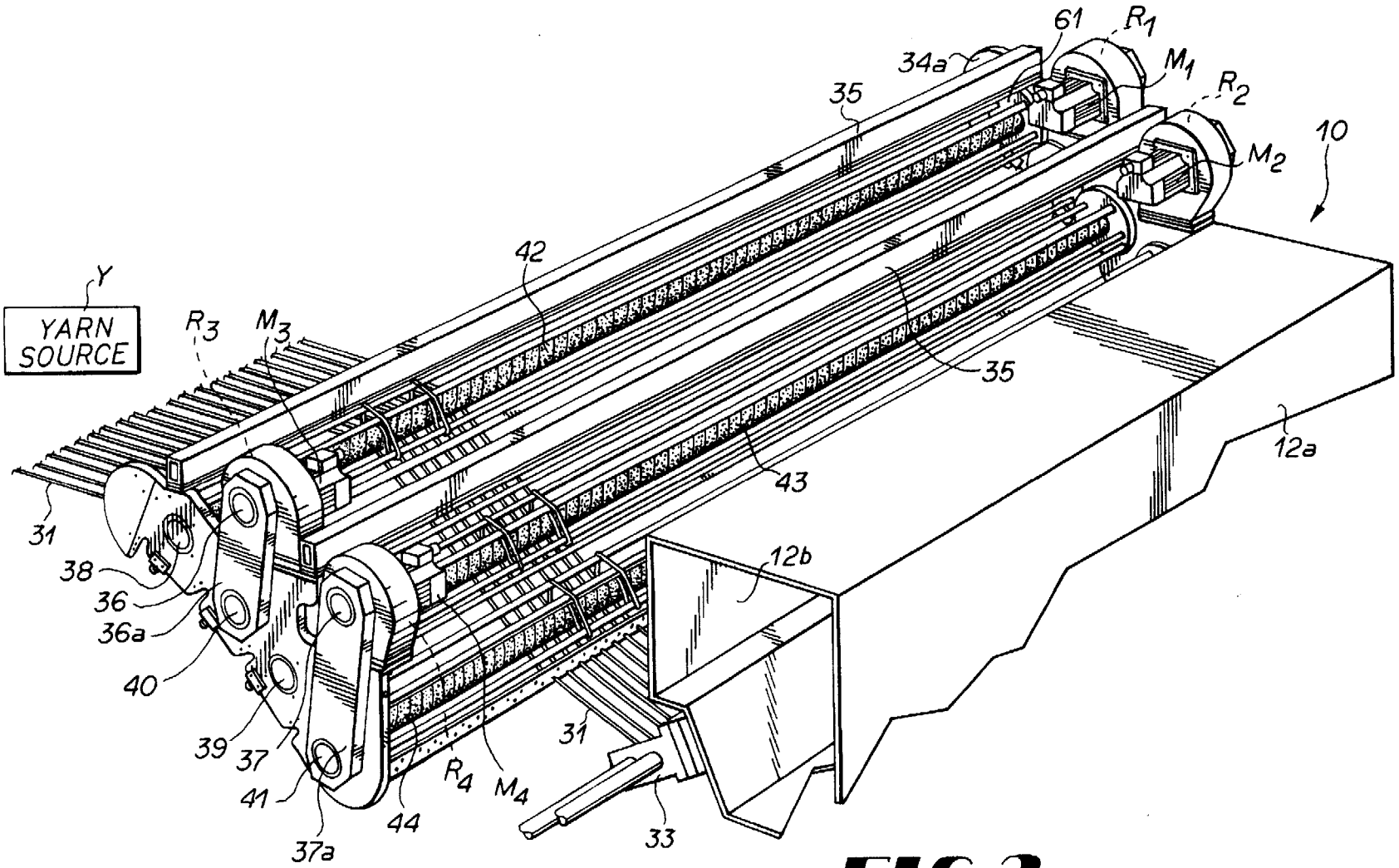
FIG. 2 is a fragmentary perspective view of a portion of the front yarn feed mechanism of FIG. 1.
Figure 9:
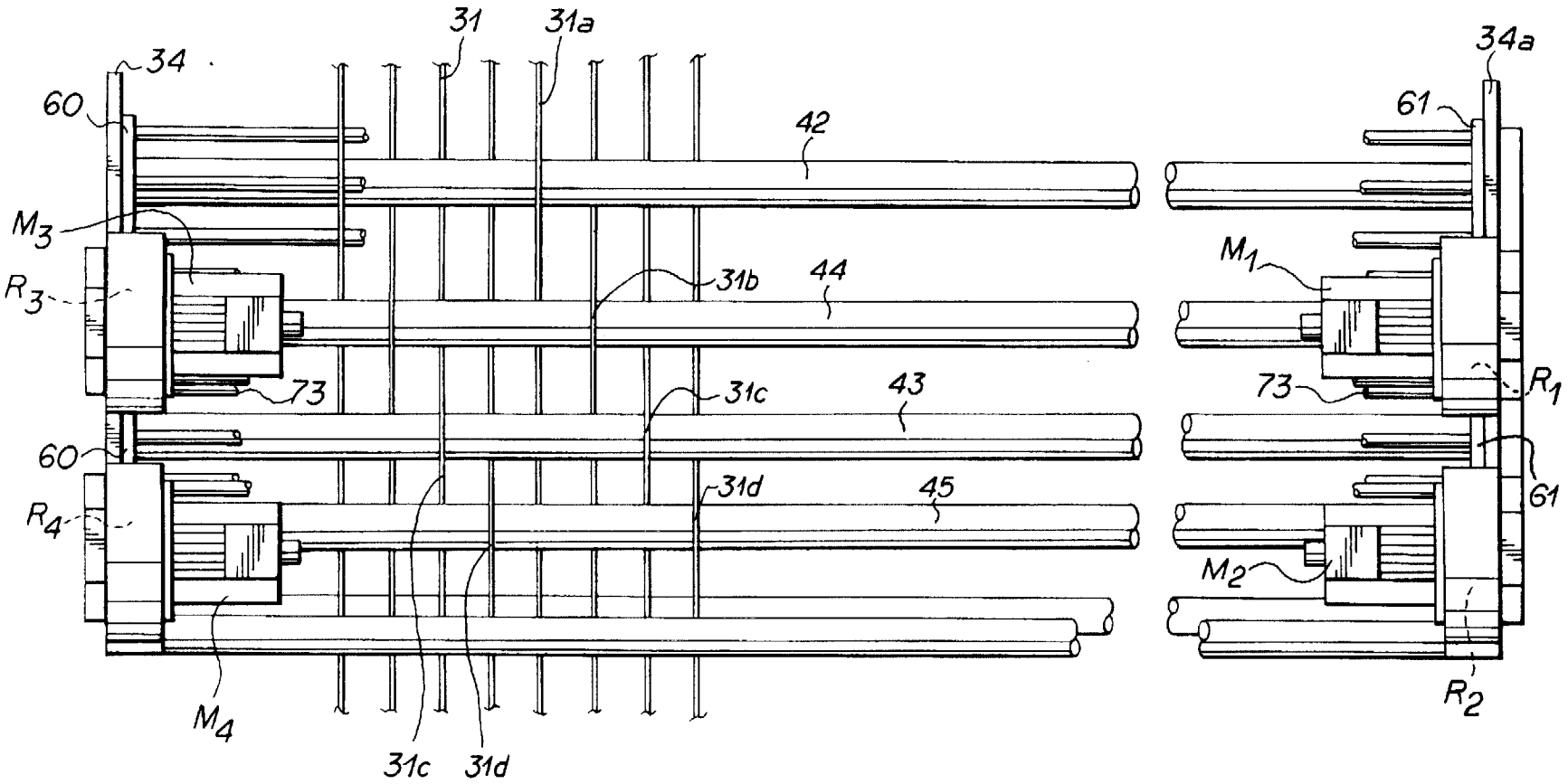
FIG. 9 is a framentary plan view of a portion of the yarn feed assembly shown in FIG. 2 illustrating selected ones of the yarns passed over selected ones of the control rods.

Front yarn feed mechanism 30 has four servomotors M1, M2, M3 and M4, as shown in FIGS. 2, and 9, that drive shafts, such as drive shafts 36 and 37 illustrated in FIG. 2, through reducers R1, R2, R3 and R4, respectively. Drive shafts 36 and 37 in turn drive roll shafts 38, 39, 40 and 41, through conventional drive trains, the drive trains being housed within suitable covers, such as covers 36*a* and 37*a*. Each drive train includes a sheave, such as sheave 28 (FIG. 1), driving an endless timing belt, such as belt 28*a*, which in turn drives a wheel or sheave, such as sheave 28*b*, on a roll shaft, such as roll shaft 29, as seen in FIG. 1. Hence, the four servomotors M1, M2, M3, and M4, respectively, control and drive the four yarn feed rolls 42, 43, 44, and 45, respectively, best shown in FIG. 9. Each of the yarn feed rolls 42, 43, 44, 45 is provided with a roughened periphery, such as periphery 42*a* seen in FIG. 3. Below and on opposite sides of each yarn feed roll, such as roll 42, are a pair of angle iron yarn guides 55 and 56 which run parallel to the axes of the yarn feed rolls. The yarn guides 55 and 56 are each provided with a spaced series of transversely aligned staggered holes 55*a* and 56*a*, respectively, defined therein and through which respective ones of the yarns 31 pass. The ends of the yarn guides 55 and 56 are secured to and supported by the inner surfaces of the brackets 34 and 34*a*. Adjacent the apexes of yarn guides 55, 56 are yarn slide bars 57 and 58, as seen in FIG. 3, over which the yarns are passed and for carrying the yarns thereon with respect to the yarn feed roll assemblies supported on brackets 34, 34*a*.

Each yarn feed roll, for example roll 42, terminates inwardly of the inner surfaces of the brackets 34, 34*a*, so as to provide sufficient space to respectively receive an opposed pair of annular, radially extending, concentrically disposed control rod indexing plates 60 and 61. Each of indexing plates 60, 61 is rotatably journaled on brackets 34, 34*a*, respectively, by a flange cylindrical sleeve 62 mounted by a flange (not illustrated) flat against the inner surface of bracket 34 or 34*a*, this flange being held in place by bolts 65, seen in FIG. 1. Each sleeve 62, also receives a bearing, such as bearing 64 (FIG. 3) for journaling the ends of the roll shaft, such as shaft 38.

Figures 3, 4:
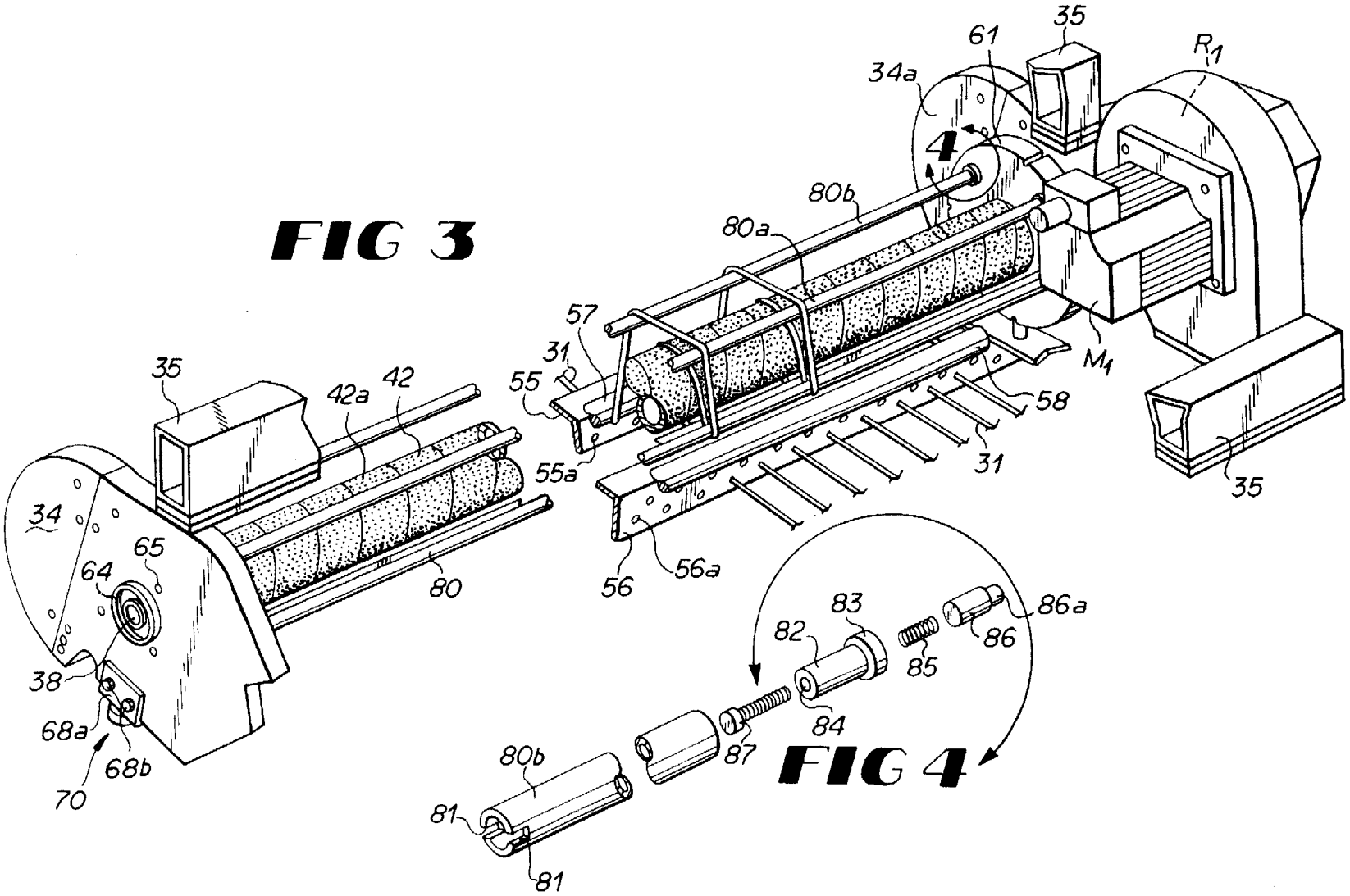
FIG. 3 is a fragmentary perspective view of one of the yarn feed roll assemblies, and its associated control rods, of the yarn feed mechanism of FIG. 2.
FIG. 4 is an enlarged exploded perspective view taken in the region of numeral 4 in FIG. 3 illustrating an end portion of one of the control rods of the yarn feed roll assembly.

Referring now to FIG. 3, each of brackets 34, 34*a* is provided with a plurality of spaced detent members 68 (FIGS. 5–8), respectively, below the indexing plates 60, 61, each detent member including a channel shaped base 68*a* bolted, by bolts 68*b*, in place along the lower edge of the bracket 34 or 34*a*. A locking mechanism 70, i.e. a locking bolt or stop, is threadedly received in base 68*a* so that its distal end portion is adapted to be aligned selectively with any one of a plurality of spaced peripheral notches or recesses 72 (FIGS. 5 to 8) defined in the periphery of indexing plates 60, 61. These notches or recesses 72 are circumferentially spaced at approximate 90° intervals along the periphery of each indexing plate 60 or 61 so that a yieldable plunger 70*b* (FIG. 5) of the cooperating locking mechanism 70 can protrude into a selected notch 72 when that notch is aligned with the locking mechanism, as shown in FIGS. 5 to 8.

Still referring to FIGS. 5 to 8, locking mechanism 70 has an external knurled head 70*a* at its proximal end and carries a spring loaded plunger 70*b* in its distal end. Plunger 70*b* has a rounded tip, suitable for being received in one of the recess 72. When the locking mechanism is released, by retracting the head 70*a*, for example, plunger 70*b* is allowed to be yieldably moved toward base 68*a* for readily permitting the manual rotation of indexing plate 60 about its concentric axis with its respective yarn feed roll. The plunger 70b, however, is normally resiliently urged into one of recess 72 when the indexing plate 60 aligns with the recess. Plunger 70b will yield to manual rotational force applied to the indexing plates 60, 61, but only when the locking mechanism is in its released position, i.e. head 70a has been released. Once the locking mechanism is tightened, it will lock indexing plates 60, 61 in the selected angular position.

For maintaining the opposed pairs of indexing plates 60, 61 in axial alignment with each other so that they may be simultaneously rotated, each pair of opposed indexing plates is provided with an alignment bar 73, seen in FIGS. 5 to 8, the ends of which are respectively received in opposed supports 75. Each alignment bar 73 is preferably a length of angle iron which is secured at its ends to the supports, such as support 75, which, in turn are bolted to the associated indexing plate 60 or 61.

Extending between each opposed pair of indexing plates 60, 61, and spaced approximately 90° apart from each other, are a plurality, preferably three, elongate, straight, polished, steel, yarn control rods 80, 80a and 80b, as shown in FIGS. 3 and 5 to 8. The control rods function as yarn applying members. Control rods 80, 80a and 80b are identical to one another, each rod, such as rod 80b in FIG. 4, for example, being a hollow tubular cylindrical member, the proximal end of which is provided with a pair of transverse notches 81 and the distal end of which is provided with a yieldable plug assembly. This plug assembly includes a lug 82 having a cylindrical body received in the distal end of rod 80b and an enlarged collar 83 at one of its ends. Lug 82 has an internal axial bore 84, and is counterbored so as to provide an internal arresting flange (not shown) at collar 83. The bore 84 receives an axially movable plunger 86 having a protruding tip 86a, the plunger 86 being urged into a seated position against the internal flange of collar 83 by a coiled compression spring 85, which, in turn, is confined in a compressed position within bore 84 by the end of machine screw 87 threadedly received in the end of bore 84 opposite plunger 86. Lug 82 is press fit into the distal end of the control rod, in FIG. 4 this being control rod 80b so that the tip 86a of plunger 86 protrudes outwardly from the collar 83 of lug 82. The tip 86a thus forms a yieldable spring loaded detent for removably retaining the control rod in place between the two indexing plates 60, 61.

For receiving the ends of the yarn control rods 80, 80a, 80b, the indexing plates 60, 61 are provided with opposed pairs of holes, recesses, or sockets (not illustrated)spaced approximately 90 degrees apart from one another about the yarn feed roll. Each of the sockets of plate 60 will have a transverse pin (not shown) fixed in and extending across the socket for being received in slots 81 formed at the proximal end of control rod 80b for preventing the rotation of the control rod in the socket. This holds true as well for control rods 80 and 80a. This prevents the control rods from rotating about their own respective axes.

The spring loaded plunger 86, when depressed into the distal end of control rods 80, 80a or 80b, respectively, fits into corresponding sockets on the indexing plate 61 so as to yieldably hold the distal ends of control rods 80, 80a, 80b in their prescribed sockets. When, for example, the control rod 80b is urged in a direction toward its plunger 86, to the right in FIG. 3, plunger 86 will be urged into the lug 82 sufficiently so that the proximal end of the plunger may be removed from its control rod socket. Thus, control rods 80, 80a, 80b are easily removable from between the two indexing plates 60, 61 when it is desired to select yarns to be wrapped around respective ones of the yarn feed rolls, but are normally retained in positions parallel to each other and parallel to the axis of yarn feed rolls 42, 43, 44 or 45, respectively, spaced from the periphery of such yarn feed roll transversely with respect to yarns 31.

So constructed, each one of the respective yarn feed rolls 42–45, as well as its accompanying indexing plates 60, 61, and its control rods 80–80b, and alignment bar 73 for joining the two opposed indexing plates together, form an integral yarn feed roll assembly. As shown in FIG. 1, therefore, there are four yarn feed roll assemblies formed as a part of each one of the two yarn feed mechanisms, rear yarn feed mechanism 20, and front yarn feed mechanism 30. As described hereinabove, each one of the yarn feed roll assemblies can be rotated about its respective axis independently of the other ones of the yarn feed roll assemblies, and may be locked into any one of a variety of angular positions about the axis of the appropriate yarn feed roll for varying the angular wrap of respective ones of yarns 21, 31 about the respective ones of the yarn feed rolls, as described in greater detail below.

As best seen in FIG. 3, the yarn guides 55 and 56 for each yarn feed roll, such as yarn feed roll 42, are positioned sufficiently below the feed roll so that when the tufting machine is threaded, the yarns 31 pass from the yarn source 32, schematically illustrated in FIG. 1, through successive opposed pairs of aligned holes, such as holes 55a, 56a, and thence to the next adjacent pair of yarn guides for the next adjacent yarn feed roll and so on. All of the yarns 31 are passed in parallel, downward, and inwardly extending paths toward tufting machine 10 so that the intermediate portions of the yarns which pass between the pairs of yarn guides for each yarn feed roll, such as guides 55 and 56 of FIG. 3, associated with the respective yarn feed rolls 42, 43, 44, 45, are spaced outwardly and downwardly from the respective yarn feed rolls so that yarn increments are accessible by the machine operator, as he or she stands on the floor on which the tufting machine is positioned or on a platform positioned at the tufting machine, adjacent the appropriate yarn feed mechanism 20 or 30, as the case may be.

When the needles; 16 of tufting machine 10 are threaded with yarns 31, for example, a "blanket" of staggered, parallel yarns 31 (FIGS. 2, 9) are therefore fed from the yarn source 31 through opposed holes 55a, 56a (FIG. 3) in the uppermost yarn guides 55, 56, and then passed through appropriate holes in the next successive pair of yarn guides for the next successive yarn feed roll, so that the yarns pass successively beneath each of yarn feed rolls 42, 43, 44, and 45 so that none of the yarns 31 normally engage any portion of the external periphery of the respective yarn feed rolls. Yarns 31 are then passed through yarn puller 33 (FIG. 1), and then threaded through yarn jerkers (not shown) mounted on the needle bar with respect to the needles. Yarns 21 are threaded in the same manner through the rear yarn feed mechanism 20 as are yarns 31 described above.

At this stage, none of the yarn feed rolls 42, 43, 44, 45 engage any of the yarns 31; however, yarns 31 are guided so that they pass outwardly of and adjacent the bottom peripheral portion of yarn feed rolls 42, 43, 44, 45 Yarn feed rolls 42, 43, 44 and 45 are positioned adjacent the bottom edges 34b of brackets 34 and 34a in spaced series, here an arcuate array (FIG. 1) facing upwardly and away from the tufting machine 10 so that their peripheries are spaced from, and adjacent, yarns 31 and are thus readily accessible to a machine operator standing at or near the tufting machine. Also, if so desired, it is anticipated that rear yarn feed mechanism 20 and front yarn feed mechanism 30 may each extend vertically upward and away from the tufting machine, extend outwardly and horizontally away from the tufting machine, or may extend outwardly along a straight line angled away from the frame of the tufting machine as illustrated generally in FIG. 10. Yarn feed rolls 42, 43, 44 and 45, are, of course, parallel to one another and extend transversely across all of yarns 31 extending transversely across the transverse width of the tufting machine, as illustrated in FIG. 1.

Figure 10:
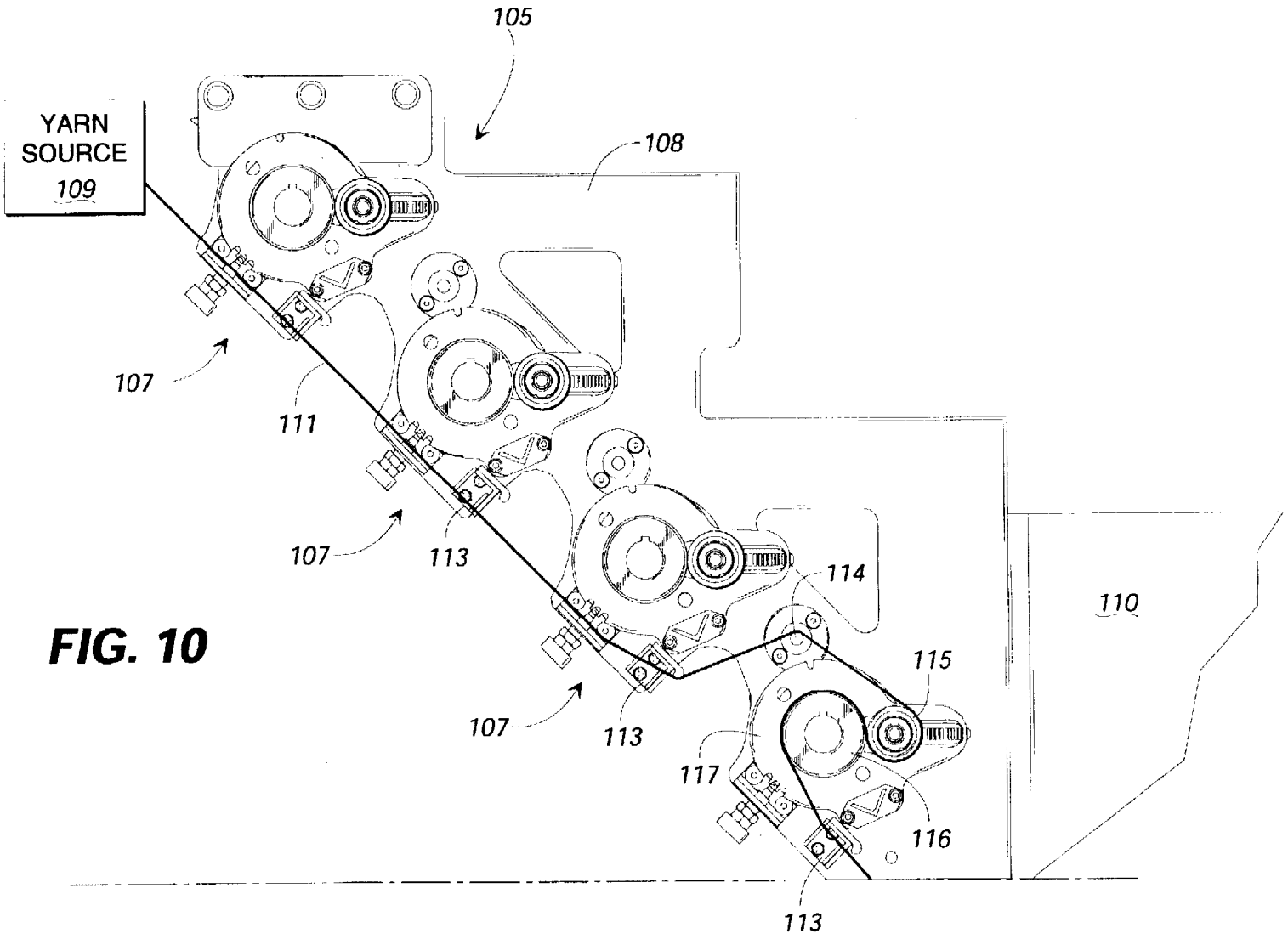
FIG. 10 is an end elevational sectional view of a second embodiment of the yarn feed mechanism of the invention.

A second embodiment of the tufting machine pattern yarn feed mechanism of this invention is illustrated in FIGS. 10–15C. Referring first to FIG. 10, a yarn feed mechanism 105 is illustrated having a spaced series, in this instance four, yarn feed roll assemblies 107 positioned along a common axis (not illustrated) extending upwardly and outwardly away from tufting machine 110. Yarn feed mechanism 105 may be either a front yarn feed mechanism, or a rear yarn feed mechanism, and is identical in construction and usage in both instances. Each one of the yarn feed roll assemblies is supported on a pair of spaced support brackets 108, one of which is illustrated in FIG. 10, similar in construction and function to support brackets 24, 34 of the first embodiment of the invention, the support brackets being mounted to a side plate (not illustrated) formed as a part of tufting machine 110.

As schematically illustrated in FIG. 10, yarn feed mechanism 105 is supplied with a plurality of yarns 111 from a yarn source 109. A single yarn 111 is illustrated in FIG. 10 for clarity. Yarn 111 extends from yarn source 109 downwardly and inwardly toward tufting machine 110 by being passed through a spaced series of yarn guides 113. The yarn is passed from yarn guides 113 toward the needle bar (not illustrated) of the tufting machine. In FIG. 10, yarn 111 is also shown being passed over a yarn idler rod 114 after first being passed through the yarn guides 113 as described above, such that the yarn is passed partially about a pinch roller 115 engaged with a portion of the peripheral surface of a yarn feed roll 116 so that yarn 111 is partially wrapped about the periphery of pinch roller 115, as well as yarn feed roll 116, and then is passed through the last yarn guide 113 illustrated in FIG. 10 and passed toward a yarn puller (not illustrated) similar in construction to yarn puller 33 of FIG. 1.

Still referring to FIG. 10, each one of yarn feed roll assemblies 107 includes a spaced pair of opposed, annular, radially extending indexing plates 117 constructed in fashion similar to indexing plates 60, 61 of the first embodiment of the invention, although only a single indexing plate 117 for each one of the yarn feed roll assemblies is illustrated in FIG. 10 for the purpose of clarity. One of indexing plates 117 is illustrated in greater detail in FIG. 14, in which it is shown that the indexing plate has an annular shaft opening 119 formed centrally within the indexing plate for being passed over the appropriate yarn feed roll shaft (not illustrated) similar to drive roll shafts 38–41 of FIGS. 2 and 9 of the first embodiment of the invention. Defined on the peripheral portion of indexing plate 117 is a first series of radially spaced recesses 120 for holding the pinch roller assembly 133 (FIG. 12) in the yarn applying position, and a radially spaced second recess 121 for positioning indexing plates 117, and pinch roller assembly 133 carried thereon, into the yarn receiving position at the appropriate orbital position about the axis of the yarn feed roll. Recesses 120, 121 thus function in Fashion similar to recesses 72 defined in indexing plates 60, 61 of the first embodiment of the invention.

Unlike indexing plates 60, 61, indexing plate, or disc, 117 includes a slotted opening defined within the disc, in which a slidable stub shaft mount is captured by a head cap screw (not illustrated) passed transversely through the periphery of indexing plate 117 with respect to the slot for limiting the travel of the stub shaft mount 124 within slot 123. Stub shaft mount 124 has a groove (not illustrated) defined in the two opposed sides thereof engaged with the side wall of slot 123, each groove being received on a respective one of a pair of opposed and elongate ridges 127 (FIG. 14) formed in the opposed sides of the slot for guiding, and retaining, stub shaft mount 124 within the slot. A compression spring 128 is passed about a mounting pin 129, the mounting pin being threaded into the peripheral portion of the indexing disc and being passed into a hole (not illustrated) defined in the stub shaft mount so that the stub shaft mount, and the spring, can freely travel along the mounting pin as pinch roller 115 (FIG. 1) is compressed against yarn feed roll 116 for controlling the yarn feed rate of the yarn wrapped about the pinch roller and the yarn feed roll. The degree of compression exerted by spring 128 against pinch roller 115, and in turn against the yarn feed roll 116 (FIG. 1) may be varied dependent upon which one of recesses 120 locking mechanism 158 (FIG. 12) is received in, and used to lock the indexing disc in position about yarn feed roll 116.

Figure 11:
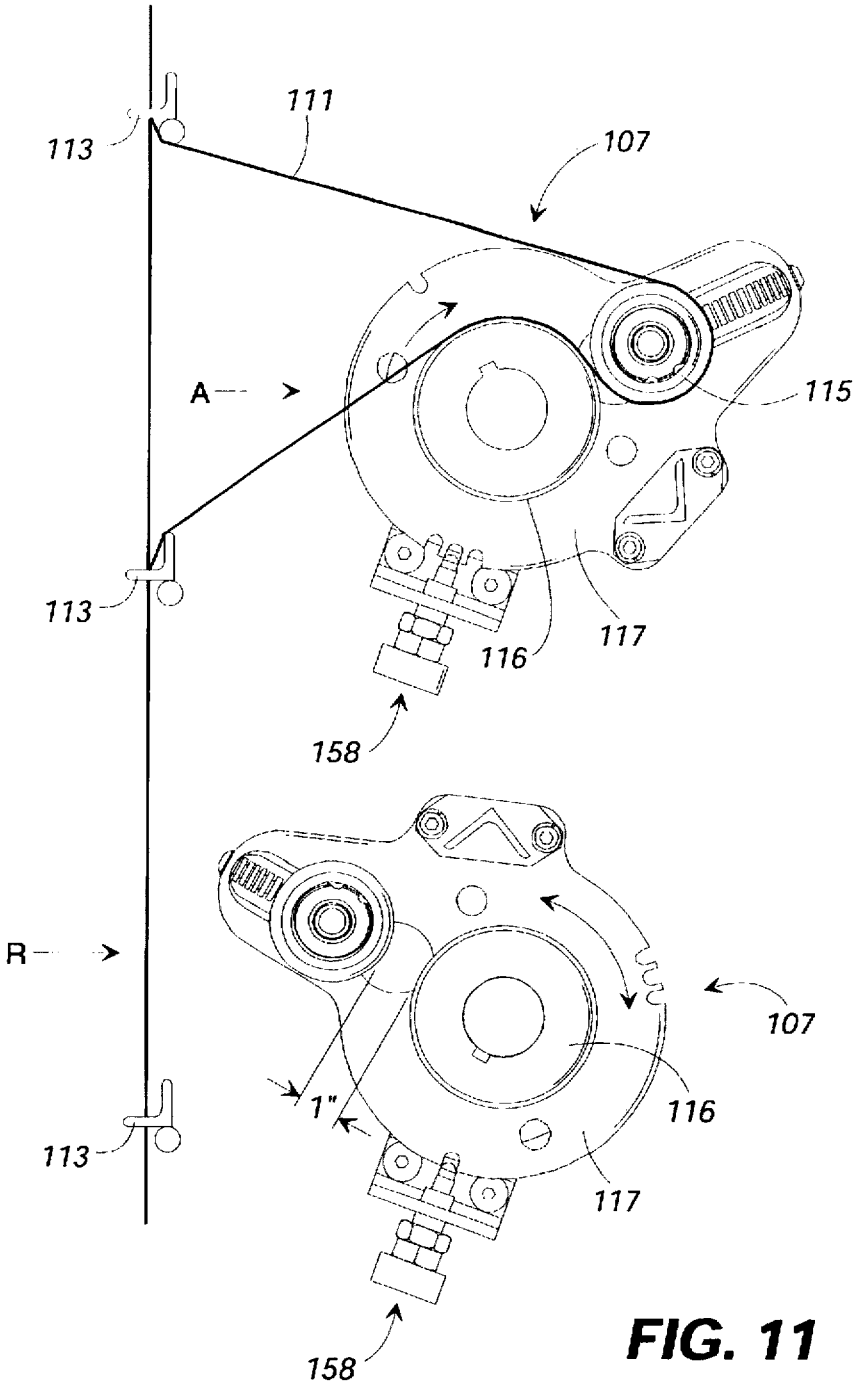
FIG. 11 is a partial end elevational view schematically illustrating two yarn feed roll assemblies of the second embodiment of the invention placed in a yarn applying position, and a yarn receiving position, respectively.

As with the yarn feed roll assemblies of the first embodiment of this invention, yarn feed roll assemblies 107 of the second embodiment, and more particularly indexing plates 117, may be rotated so that pinch roller 115 eccentrically moves from a yarn receiving position, designated by the reference character "R" in FIG. 11, into a yarn applying position, designated by the reference character "A" in FIG. 11, for wrapping yarn 111 at least partially about the periphery of a driven yarn feed roll 116. This is also illustrated generally in FIG. 10, in which a yarn 111 is shown being at least partially wrapped about yarn feed roll 116 of the bottom most yarn feed roll assembly closest to tufting machine 110.

Figure 12:
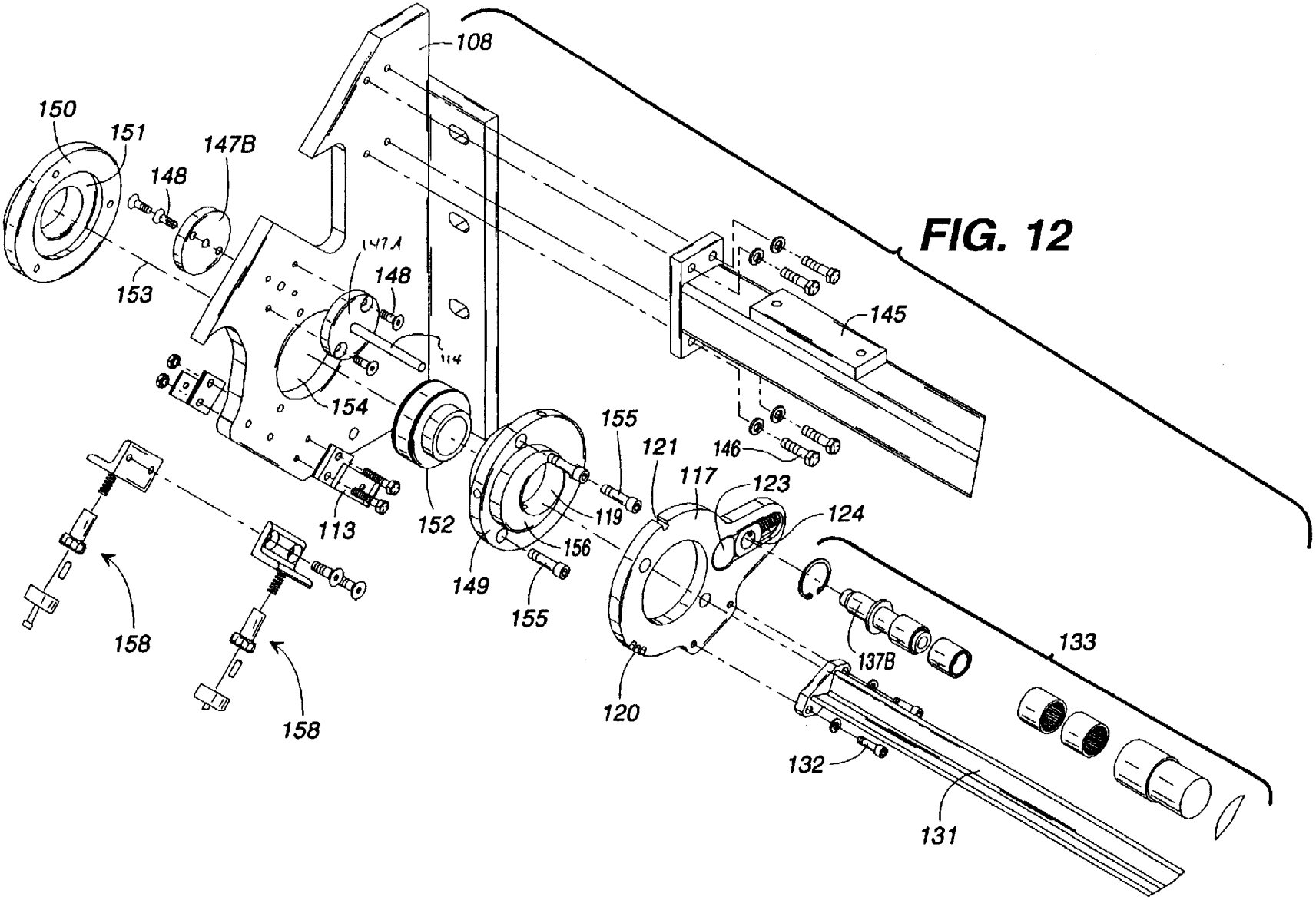
FIG. 12 is a partial fragmentary perspective view detailing the construction of the yarn feed roll assembly of the second embodiment of the invention.
Figure 13:
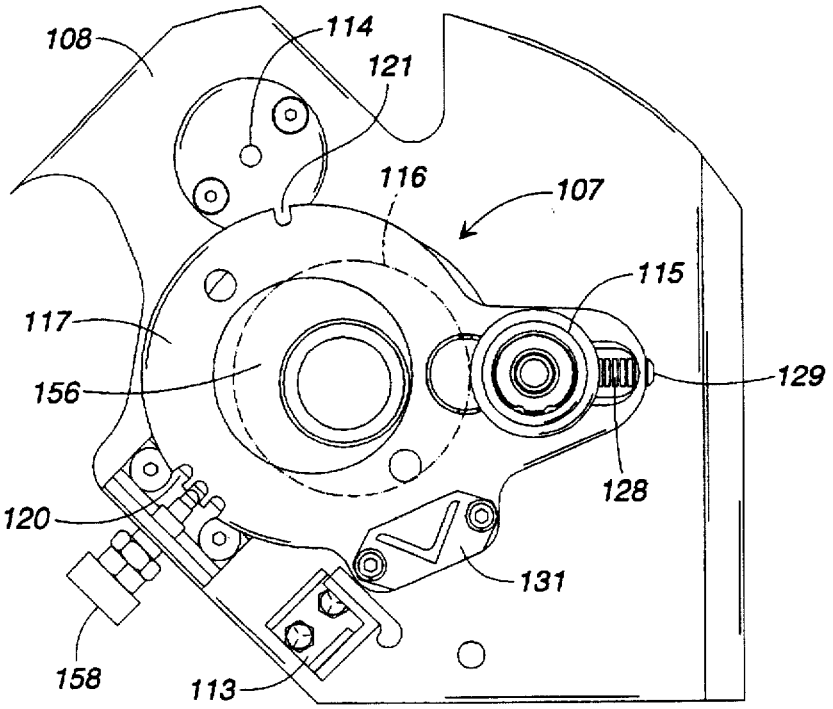
FIG. 13 is a partial end elevational sectional view of a yarn feed roll assembly of the second embodiment of the invention.

The novel structure of yarn feed roll assemblies 107 which allows for the unique usage of the yarn feed roll assemblies, as shown in FIGS. 10, 11, is illustrated in greater detail in FIG. 12. As shown in FIG. 12, an elongate alignment bar 131, identical in function to alignment bar 73 illustrated in FIGS. 5–8, is fastened to each one of indexing plates 117, so that the indexing plates may be rotated together about the respective ones of the yarn feed rolls 116 (FIG. 13). Alignment bar 13 1 thus extends parallel to, and is spaced from, yarn feed roll 116, as illustrated generally in FIG. 13. Alignment bar 131 is comprised of a length of angle iron fastened to a suitable base, the base in turn being fastened to indexing plate 117 with fasteners 132.

Figure 15B:
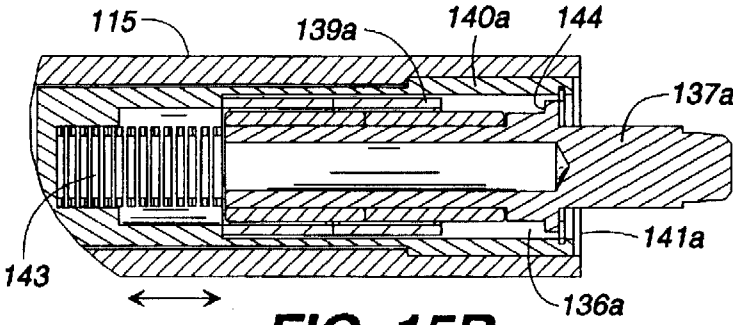
FIG. 15B is a partial side elevational sectional view of the spring loaded stub shaft and journal assembly received in one of the ends of the pinch roller assembly of FIG. 15A.
Figure 15C:
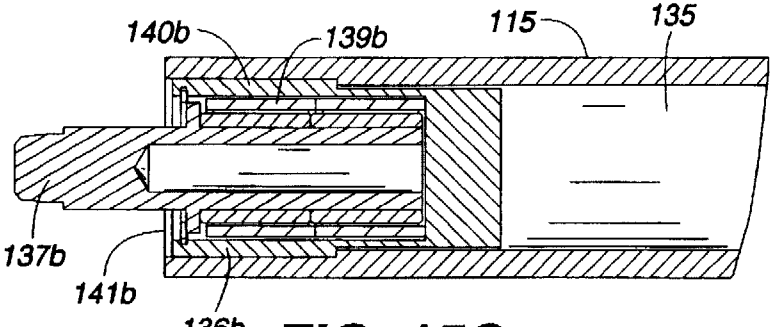
FIG. 15C is a partial side elevational sectional view of the stub shaft and journal assembly received in the other end of the pinch roller assembly of FIG. 15A.
Figure 15A:
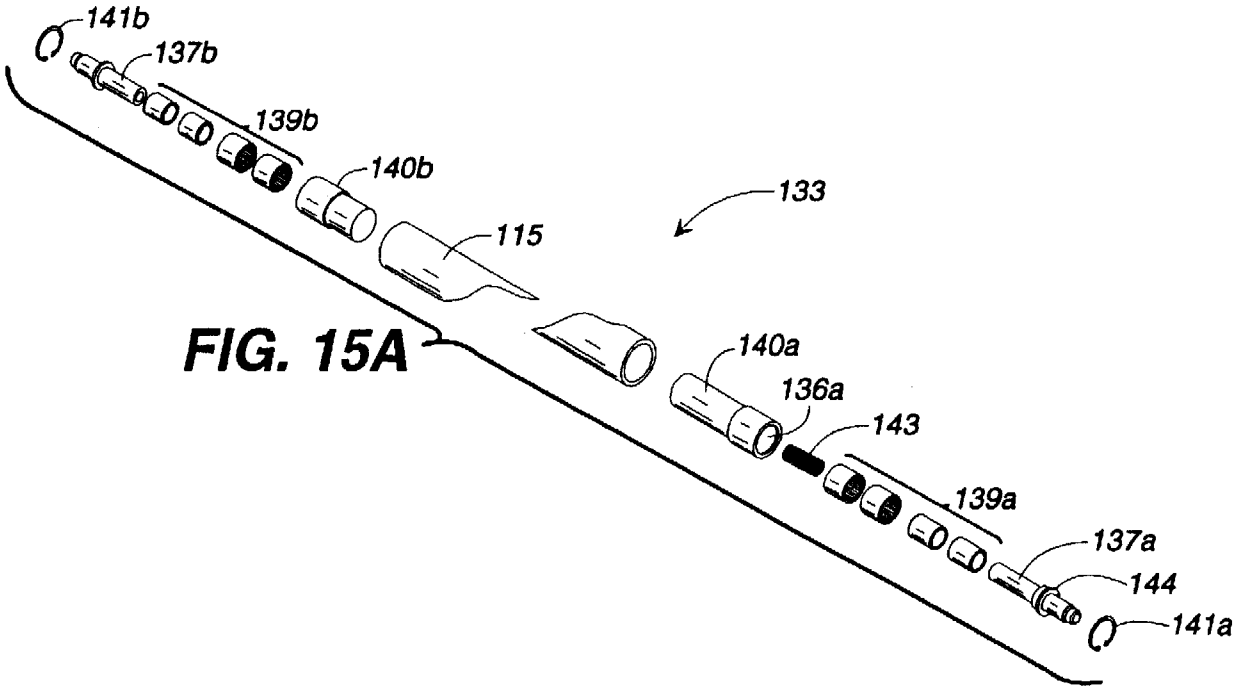
FIG. 15A is a fragmentary perspective view of a pinch roller assembly used with the yarn feed roll assembly of the second embodiments of the invention.

Still referring to FIG. 12, an elongate stub shaft **137*b*, a part of pinch roller assembly 133, is positioned at the distal end of pinch roller 115 and is received in one of the stub shaft mounts 124. Pinch roller assembly 133 is illustrated in FIGS. 15A through 15C. The pinch roller assembly includes an elongate preferably solid cylindrical pinch roller 115, although the pinch roller could be hollow if so desired. The pinch roller is constructed of a rigid and durable material, preferably a metallic material, for example a polished steel. Although not illustrated in FIGS. 15A–15C, it is anticipated that the periphery of pinch roller 115** could be surface coated with a soft rubber material or a roughened surface, if so desired, although it is preferred that the pinch roller has a smooth surfaced exterior periphery.

Still referring to FIG. 15A, the pinch roller assembly includes a pair of internal axial bores **136*a*, *b*defined at the two opposed ends of pinch roller 115, as illustrated more generally in FIGS. 15B and 15C. Received within each one of the respective axial bores is an elongate stub shaft 137***a, b*, supported for rotation by a journal assembly 139*a, b*, respectively, housed within respective ones of housings 140*a, b*. It is anticipated that journal assemblies 139*a, b* will use needle bearings, although other suitable roller bearings could be used. Each one of the journal assemblies is passed into respective ones of the housings, the housings in turn being retained within the opposed ends of pinch roller 115 by a spring steel retaining ring 141*a, b*, respectively. As seen in FIGS. 15A and B, stub shaft 137*a* differs from stub shaft 137*b* by being longer, and by being spring loaded by a compression spring 143. As best shown in FIG. 15B, stub shaft 137*a* is passed into journal assembly 139*a* and in turn into housing 140*a*, the entire assembly then being passed into internal axial bore 136*a*, which in the course of so doing compresses compression spring 143 placed therein with housing 140*a* which is also passed at least partially over the proximal end of stub shaft 137*a*. Thereafter, retaining ring 141 a is placed in position at the opening defining axial bore 136*a* in pinch roller 115, whereupon compression spring 143 acts to compress the annular shoulder 144 of stub shaft 137*a* against retaining ring 141*a*. In this fashion, the distal end of stub shaft 137*a* is urged outwardly of pinch roller 115, so that it can be passed into the appropriate one of stub shaft mounts 124 when positioning the pinch roller within the stub shaft mounts of the spaced and opposed indexing plates 117 for orbitally carrying, and rotatably supporting pinch roller assembly 133 thereon.

FIG. 15C illustrates stub shaft 137*b* captively held within internal axial bore 136*b* at the opposed end of pinch roller 115. Stub shaft 137*b* does not reciprocably move within the axial bore, but is instead held in a fixed position. When positioning pinch roller 115 on indexing plates 117, stub shaft 137*b* is placed into one of the two spaced stub shaft mounts 124 held on a respective one of indexing plates 117, while the spring loaded stub shaft 137*a* is pushed inwardly of the axial bore, the pinch roller is then moved into position and is axially aligned with the remaining one of stub shaft mounts 124, and then released so that the stub shaft is urged into and through the stub shaft mount to lock the pinch roller in position onto its associated feed roll assembly 107.

Referring now to FIG. 12, one of support brackets 108 is illustrated, being fastened to a spaced opposite hand support bracket (not illustrated) by one of a spaced series of elongate cross bars 145 which extend parallel to the yarn feed rolls, and transversely across the width of tufting machine 110. Cross bar 145 is fastened to support bracket 108 with a plurality of fasteners 146 in conventional fashion. For the sake of clarity, only a portion of support bracket 108 is illustrated in FIG. 12, the entire support bracket 108 being illustrated in FIG. 10. As with the first embodiment of the invention, a second, spaced, opposed, and parallel support bracket (not illustrated) is provided for supporting the feed roll assemblies 107 thereon, and therebetween.

Also shown in FIG. 12, as well as in FIGS. 10 and 13, is a yarn idler rod 114, the yarn idler rod being supported by a yarn idler rod base comprised of an inside rod base portion 147*a*, and an outside idler rod base portion 147*b* , which are fastened to one another by a plurality of fasteners 148 so that the idler rod bases sandwich support bracket 108 therebetween. Yarn idler rod 114 is supported on idler rod bases 147*a, b* so that it remains stationary thereon, and is not supported for rotation. Each of yarn idler rods 114 are constructed in fashion similar to control rods 80, 80*a*, and 80*b*, respectively. Accordingly, the ends of yarn idler rods 114 will include either a spring loaded plunger similar to plunger 86, or notches similar to notches 81, for being received in opposed sockets (not illustrated) formed as part of the spaced and opposed inside yarn idler rod bases 147*a*, respectively.

The respective ones of indexing plates 117 are supported for rotation on support bracket 108 by a pair of hubs, an inside hub 149, and an outside hub 150, fastened to one another so that they sandwich support bracket 108 in much the same fashion as do idler rod bases 147*a, b*. However, and as shown in FIG. 12, both inside hub 149 and outside hub 150 include a bearing recess 151, shown only for outside hub 150 in FIG. 12, for receiving a roller bearing assembly 152 therein which in turn rotatably supports yarn feed roll 116 (not illustrated) for rotation about longitudinal axis 153. As shown in FIGS. 12 and 13, however, and unlike indexing plates 60, 61 of the first embodiment of the invention, indexing plates 117 do not concentrically orbit longitudinal axis 153, and thus the yarn feed rolls, rather indexing discs 117 eccentrically orbit longitudinal axis 153 so that pinch roller 115 is moved from the yarn receiving position R to the yarn applying position A, respectively, illustrated in FIG. 11. This is accomplished by the provision of a raised eccentric cam 156 formed on the exterior of inside hub 149 that faces inwardly of support brackets 108, and is positioned outwardly of yarn feed rolls 116, such that indexing plates 117 are received thereon, respectively, by passing the cam/shaft opening 119 defined in the indexing plate over the raised eccentric cam so that the indexing plate slides on the peripheral surface of the eccentric cam, thus imparting an eccentric orbital motion to respective ones of pinch rollers 115 orbited about respective ones of yarn feed rolls 116. It is by this construction, therefore, that the pinch roller may be moved from the yarn receiving position of FIG. 11, to the yarn applying position for wrapping individual yarns 111 at least partially about the periphery of respective ones of yarn feed rolls 116.

As illustrated in FIGS. 12 and 13, each indexing plate is provided with a locking mechanism 158, constructed in fashion identical to locking mechanism 70 of the first embodiment of this invention, and thus not described in greater detail herein. The plunger (not illustrated) of the respective ones of locking mechanisms 158 is received in recess 121 for holding the yarn feed assembly in its yarn receiving position, and may be positioned within any one of the three recesses 120 for varying the degree of compression of pinch roller 115 against the periphery of feed roll 116 once the yarn is wrapped partially about the periphery of the yarn feed roll.

The embodiment of yarn feed mechanism 105 illustrated in FIGS. 10 through 15C also has four servomotors (not illustrated) similar to servomotors M1, M2, M3 and M4 illustrated in FIGS. 2 and 9, for separately driving the respective yarn feed rolls 116 independently of one another, a separate servomotor being provided as a part of each respective one of the yarn feed roll assemblies 107. As with the first embodiment of the invention, however, conventional electric motors, or any other type of suitable motor, may be used to rotate the respective yarn feed rolls. A computer or control processor will be used to operate these four servomotors, which computer or control processor may comprise a portion of the computer controlled tufting machine and process disclosed in U.S. Pat. Nos. 4,867,080, 4,981,091, and 5,005,498 to Taylor, et al., each of which is incorporated by reference as if set forth fully herein. Yarn feed mechanism 105 also include four drive shafts (not illustrated)the equal of drive shafts 36 and 37 illustrated in FIG. 2, and four gear reducers (not illustrated) similar to gear reducers R1, R2, R3 and R4, respectively. These drive shafts will in turn drive the roll shafts (not illustrated) for each one of yarn feed rolls 116 through conventional drive trains (not illustrated) housed within suitable protective covers (not illustrated) similar to covers 36*a* and 37*a* of FIG. 2. Each one of these drive trains may therefore include a sheave (not illustrated), such as sheave 28 (FIG. 1), a sprocket (not illustrated), or a drive gear (not illustrated) driving an endless timing belt (not illustrated), such as belt 28*a*, a drive chain (not illustrated), or a mechanical gear train (not illustrated), respectively, which in turn rotates the respective yarn feed roll shafts. Hence, the four servomotors control and drive the four yarn feed rolls 116 of the second embodiment of yarn feed mechanism 105.

OPERATION

Figure 5:
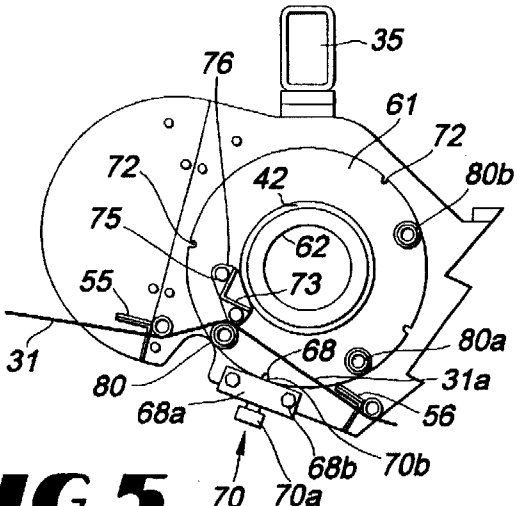
FIG. 5 is a first sequential vertical sectional view of a portion of the yarn feed roll assembly of FIG. 2 showing the indexing disc and control rods of an indexing assembly for one of the yarn feed roll assemblies in an initial position with a yarn passed over one of the control rods thereof.
Figure 7:
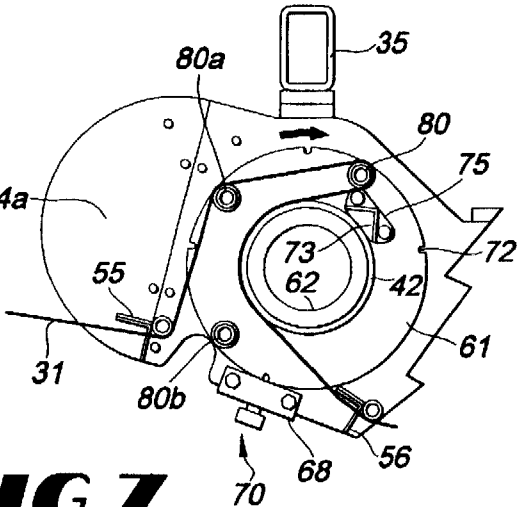
FIG. 7 is a third sequential view similar to FIG. 5 showing the indexing assembly rotated approximately 180° from the initial position.

When it is desired to cause certain of the yarns to be controlled by a prescribed yarn feed roll, such as yarn feed roll 42 for example, the locking mechanisms 70 for the indexing plates 60 and 61 are released, i.e. threaded heads 71 a are rotated so as to allow plungers 70*b* to be urged from recesses 72, in order to permit the rotation of indexing plates 60, 61. To accomplish this, alignment bar 73 (FIGS. 5 to 8) is manually grasped after the locking mechanisms are released, and the indexing plates are simultaneously rotated together so that indexing plate 61 is initially positioned in a home or yarn receiving position, as shown in FIG. 5. In the yarn receiving position of FIG. 5, none of yarns 31 yet contact a portion of the periphery of yarn feed roll 42. Thereafter, control rod 80 is removed from between the plates 60, 61, as described hereinabove, and selectively passed between the increments of certain ones of yarns 31 and the remaining one of yarns 31, as illustrated generally in FIGS. 2 and 9. When a selected (pre-determined) group of yarns 31 has been collected on yarn control rod 80, the rod is then replaced in its yarn receiving position, shown in FIG. 5. As control rod 80 is subsequently rotated or orbited (FIGS. 5, 6) about the axis of yarn feed roll 42, the control rod will draw an intermediate portion 31*a* of the yarns 31 sideways and upwardly away from the path of the yarn through yarn guides 55 and 56, and away from the remaining yarns of the yarn blanket.

Figure 6:
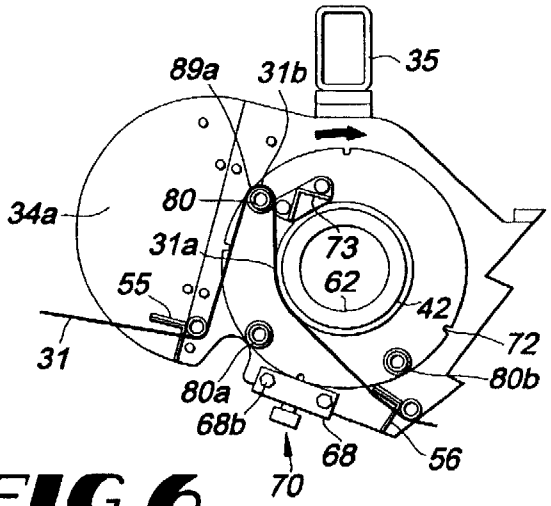
FIG. 6 is a second sequential view similar to FIG. 5 showing the indexing assembly rotated approximately 90° from the initial position.

Referring generally now to FIG. 6, after control rod 80 has been reinstalled between indexing plates 60 and 61, control rod 80*a* is then temporarily removed from between the indexing plates, whereupon indexing plates 60, 61 are rotated together through an approximate 90° arc. As the indexing plates are being moved, however, the plungers 70*b* of locking mechanisms 70 are pushed downwardly by the peripheries of the indexing plates so that the plungers 70*b* are forced inwardly of the locking mechanism and out of their notches or recesses 72 in which the plungers were retained, the plungers being subsequently urged by their respective compression springs into a successive pair of recesses 72, as shown in FIG. 6, when indexing plates 60, 61 reach the approximate 90° rotational position shown therein.

As seen in FIG. 6, control rod 80 forms a yarn bight 31*b* in which yarn 31 extends partially about a portion of the control rod for urging the yarn increments 31*a* into engagement with an initial peripheral portion of yarn feed roll 42 as the indexing discs are rotated through the 90° arc. Control rod 80*a* is then repositioned between the indexing plates so as to be positioned outwardly of yarn increment 31*a* held against the exterior of yarn feed roll 42. Control rod 80*b* is next removed from between indexing plates 60, 61 whereupon the indexing plates are once again manually rotated through an additional 90° arc to the approximate 180° position illustrated in FIG. 7. Control rod 80*b* is then placed back into its mounting sockets (not illustrated) in its original position on the indexing discs. Control rod 80 has therefore rotated yarn bight 31*b* from the 90° position of FIG. 6 to the 180° position of FIG. 7, and has carried the intermediate portion 31*a* of the yarn 31 progressively further around the periphery of yarn feed roll 42, so that the yarn now circumscribes approximately 160° of the exterior periphery of the yarn feed roll.

Figure 8:
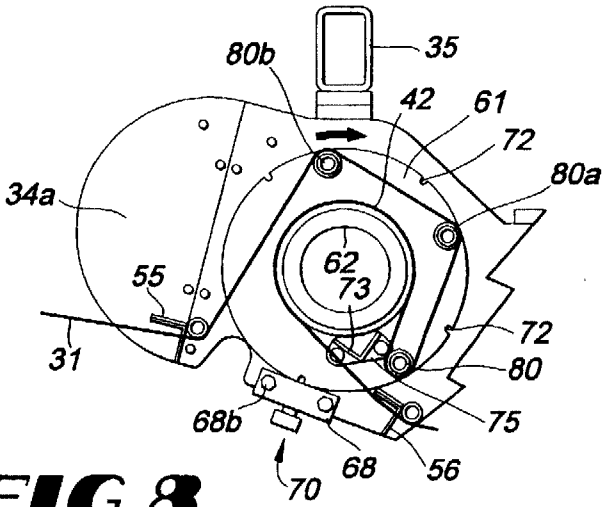
FIG. 8 is a fourth sequential view similar to FIG. 5 showing the indexing assembly rotated approximately 270° from the initial position.

Thereafter, indexing plates 60, 61 are once again rotated through an arc of approximately 90° to the approximate 270° position of indexing plate 61 illustrated in FIG. 8. In FIG. 8 the operating position of the yarn feed roll is illustrated in which the yarn 31 travels first over and partially around control rod 80 then around approximately 270° of the exterior periphery of yarn feed roll 42. The yarns 31 which are to be selectively controlled by yarn feed roll 42 are, therefore, moved out of their "normal" paths, i.e. their straight paths through yarn guides 55, 56, in which the upstream, the deviated, portions of the yarns 31 initially pass around control rod 80 and beneath control rods 80*a* and 80*b*, respectively, looping over less than the entire circumference of yarn feed roll 42, and then pass from under that portion of the periphery of the yarn feed roll with which the yarn is engaged toward and through yarn guide 56, and thence, along essentially parallel paths to the needles 16 as illustrated generally in FIGS. 1, 2, and 9.

Once the indexing plates are in the yarn applying position shown in FIG. 8, the locking mechanisms 70 are tightened so as to force plungers 71*b* into the appropriate ones of recesses 72 (FIG. 8) to lock indexing plates 60, 61 in the yarn applying position rotated approximately 270° from the yarn receiving position shown in FIG. 5. In like fashion, the remaining yarn feed rolls 43, 44 and 45 of the front yarn feed mechanism, as well as the yarn feed rolls of the rear yarn feed mechanism, may be provided with selected increments from different yarns 31, 21, respectively, so that all of the respective yarns of the yarn blanket(s) contact only one selected yarn feed roll.

If it is desired to alter the feeding arrangement of yarn 31 with respect to yarn feed rolls 42, 43, 44 and 45 of FIGS. 5 to 8, the appropriate opposed pairs of indexing plates 60, 61 are rotated back to their original or yarn receiving positions as shown for plate 61, in FIG. 5, and control rods 80, 80*a* and 80*b*, are removed, replaced, and rotated as appropriate, in reverse of the procedure described in greater detail, above. Thereafter, different selected yarn segments or increments, such as increment 31*a* of FIGS. 5 to 8, can be removed from the yarn blanket and applied to a selected yarn feed roll without re-threading needles 16, thus reducing to a minimum the manpower and time necessary to change the tufting machine over to tuft articles of another pattern or design. Also, by cutting selected yarns 31 and exchanging the yarn ends with new yarn ends drawn from a different yarn supply, and then tying the yarn ends together, different colored yarns can be fed to needles 16.

The second embodiment of the improved yarn feed mechanism of this invention operates in fashion similar to that of the first embodiment, except that an elongate pinch roller 115 is used rather than a spaced series of control rods 80, 80*a*, and 80*b*, respectively, for each yarn feed roll. Accordingly, and as illustrated generally in FIGS. 10 and 11, yarn 111 is passed through the respective spaced yarn guides 113 extending downwardly and inwardly along the length of support bracket 108, so that yarn 111 is passed toward the puller rollers (not illustrated) formed as a part of tufting machine 110, which in turn pulls the yarn toward a spaced series of needles (not illustrated) for being used in creating the patterned tufted article. When it is desired to select certain ones of the yarns from the yarn blanket (FIGS. 2, 9), the selected one of the pinch rollers 115 is released from its pair of spaced indexing plates 117, and in particular from the stub shaft mounts 124 provided as a part thereof, by pressing spring loaded stub shaft 137*a* (FIGS. 15A, 15B) inwardly of the end of the pinch roller, and then lifting the pinch roller out from between the indexing plates such that the second stub shaft 137*b* is then withdrawn from the other one of the stub shaft mounts 124 provided, as illustrated in FIG. 12. The pinch roller is then threaded through the yarn blanket so that selected ones of the yarns may be applied about the periphery of the yarn feed roll, and so that other ones of the yarns will be left undisturbed. Once this is accomplished, the pinch roller is replaced in its position on indexing plates 117 by being received within stub shaft mounts 124 in reverse of the procedure described above. Once this is accomplished, locking mechanism 158 (FIG. 12) is released in fashion described for locking mechanism 70 for the first embodiment of this invention, such that indexing plates 117 are then rotated together about feed roll 116, in eccentric fashion as opposed to concentric fashion with the first embodiment of the invention, such that pinch roller 115 moves into engagement with a portion of the periphery of yarn feed roll 116, as illustrated in FIG. 11.

Figure 14:
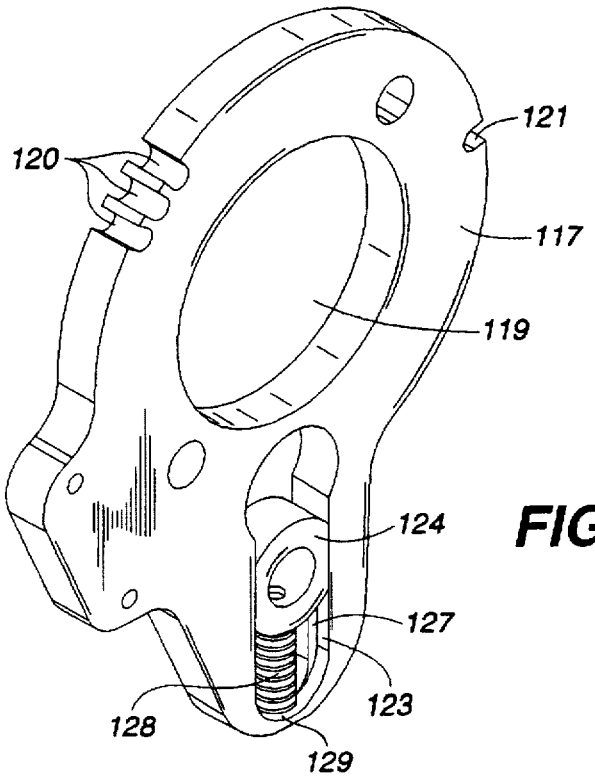
FIG. 14 is a perspective view of an indexing plate of a yarn feed roll assembly of the second embodiment of the invention.

As illustrated in FIGS. 13 and 14, in the yarn applying position, locking mechanism 158 may be received in any one of the three recesses 120 defined in the periphery of indexing plate 117 so that the amount of spring compression exerted by compression springs 143 on stub shaft mounts 124, and in turn on pinch roller 115 may be varied. This will typically occur when, for example, yarns of different diameters or weights are being used so that positive control of the yarns can be maintained with the same feed roll assemblies without the need to change out and replace either the included pinch roller 115, or yarn feed roll 116.

Yarn idler rod 114 is removed from its rod base sections 147*a, b* on both of opposed support brackets 108 in fashion identical to the removal and replacement of control rods 80, 80*a*, and 80*b*, respectively, from the sockets (not illustrated) formed as a part of the yarn feed roll assemblies of the first embodiment of the invention, such that once pinch roller 115 has; been passed between selected ones of yarns 111 for being wrapped about a portion of the periphery of yarn feed roll 116, yarn idler rod 114 is removed from its respective rod bases and the pinch roller is orbited about yarn feed roll 116 into the desired position, whereupon yarn idler rod 114 is passed under the selected yarns and used to lift them upwardly and away from the periphery of yarn feed roll 116, whereupon yarn idler rod 114 is replaced on its idler rod base portions 147*a, b*, respectively, for holding the selected yarns 1 11 away from the yarn feed roll, so that they are not engaged on the periphery of the yarn feed roll prior to being placed there by the pinch roller.

When, and if, it is desired to vary the compression of the pinch roller against the surface of the feed roll, locking mechanism 158 is released, so that the plunger (not illustrated) provided as a part thereof, may be moved to any one of the respective recesses 120 defined in the periphery of indexing plate 117. When it is desired to remove the selected yarns engaged on the periphery of yarn feed roll 116, yarn idler rod 114 is removed from its rod base portions, the locking mechanism 158 is released, alignment bar 131 is grasped and used to rotate indexing plates 117 about eccentric cam 156 so that pinch roller 115 is moved away from the periphery of the yarn feed roll, as illustrated generally in FIG. 11, whereupon pinch roller 115 is removed from stub shaft mounts 124 in the fashion described above, the yarns allowed to fall back into the yarn blanket, whereupon the pinch roller is placed back into the stub shaft mounts until the next selected series of yarns is chosen.

Thus, with both embodiments of the invention disclosed hereinabove, selective ones of the yarns may be wrapped about selected portions of the periphery of respective yarn feed rolls, the feed rolls being provided in spaced series in alignment as shown in FIG. 10, or in arcuate fashion as shown in FIG. 1, without the need to cut the yarns, or otherwise re-thread the needles 15, 16 of needle bars 14*a*, 14*b*, respectively.

While preferred embodiments of the invention have been disclosed in the foregoing specification, it is understood by those skilled in the art that variations and modifications thereof can be made without departing from the spirit and scope of the invention as set forth in the following claims. In addition, the corresponding structures, materials, acts, and equivalents of all means or step plus function elements in the claims below are intended to include any structure, material, or acts for performing the functions in combination with other claimed elements as specifically claimed herein.

We claim:

1. A yarn feed mechanism for use with a tufting machine for producing tufted articles, the tufting machine having a frame, a yarn supply, a needle bar supported on the frame and reciprocated toward and away from a tufting zone underneath the needle bar and through which a backing material is transversely passed, the needle bar having a spaced series of tufting needles aligned thereon and disposed along the length thereof for penetrating the backing material for sewing tuffs of yarn therein, and a yarn feed path along which yarns extend from the yarn supply to the respective needles of the tufting machine, said yarn feed mechanism comprising:

(a) a framework for being mounted on the frame of the tufting machine along the yarn feed path;

(b) a yarn feed roll assembly supported for rotation on said framework, said yarn feed roll assembly being positioned adjacent said yarn feed path and having:

an elongate yarn feed roll rotatably supported on the yarn feed roll assembly, said yarn feed roll extending along a longitudinal axis and having an exterior yarn driving periphery for engaging yarns thereon;

means for rotating said yarn feed roll about said axis in timed relationship with the reciprocation of the needle bar;

an orbital yarn applying member supported on the yarn feed roll assembly and being spaced from said yarn feed roll, said yarn applying member being movable about the yarn feed roll in an orbital path from a yarn receiving position for receiving an intermediate portion of selected yarns thereon, into a yarn applying position in which the yarn applying member selectively applies the selected yarns against at least a portion of the yarn driving periphery of the yarn feed roll so that the rotation of the yarn feed roll drives the yarn toward the needles of the tufting machine.

2. The yarn feed mechanism defined in claim 1 wherein said yarn applying member comprises a first elongate yarn control rod supported on said assembly in a position spaced about and parallel to the axis of said yarn feed roll, said yarn control rod being moved with said assembly concentrically about said yarn feed roll and being selectively positionable about said yarn feed roll in at least one of a plurality of yarn applying positions for holding a portion of the selected yarns in engagement with said at least a portion of the yarn feed periphery of the yarn feed roll.

3. The yarn feed mechanism defined in claim 2 including a second elongate yarn control rod spaced parallel to and radially from said first yarn control rod about said axis, said second yarn control rod being movable with said first yarn control rod for holding an increment of the yarn about and spaced from said yarn feed roll and away from engagement with the yarn driving periphery thereof.

4. The yarn feed mechanism of claim 3, wherein said first yarn control rod and said second yarn control rod are constructed and arranged to be moved together in a prescribed orbital path about said yarn feed roll.

5. The yarn feed mechanism of claim 3, further comprising a third elongate yarn control rod spaced parallel to and radially from said first and said second yarn control rods, respectively, about the axis of said yarn feed roll, said third yarn control rod and said second yarn control rod cooperating with each other for supporting said increment of yarn out of engagement with the yarn driving periphery of said yarn feed roll.

6. The yarn feed mechanism of claim 5, wherein said yarn feed roll assembly includes a spaced pair of opposed indexing plates constructed and arranged for concentric movement about the yarn feed roll axis independently of the rotation of said yarn feed roll, said indexing plates removably carrying said yarn control rods thereon, and means for releasably retaining said control rods on said indexing plates with respect to one another.

7. The yarn feed mechanism of claim 1, wherein said means for rotating said yarn feed roll comprises a motor operably engaged with a drive assembly, said drive assembly being operably engaged with said yarn feed roll.

8. The yarn feed mechanism of claim 7, wherein said motor comprises a servomotor.

9. The yarn feed mechanism of claim 1, comprising a first yarn feed roll assembly and a spaced second yarn feed roll assembly, each said yarn feed roll assembly being supported for rotation on said framework independently of the other and being positioned adjacent the yarn feed path, the feed rolls of each of said feed roll assemblies being constructed for rotation independently of one another.

10. The yarn feed mechanism of claim 1, comprising a spaced series of said yarn feed roll assemblies disposed along the yarn feed path, each yarn feed roll assembly of the spaced series of yarn feed roll assemblies being supported on said framework for rotation independently of one another and adjacent the yarn feed path, the yarn feed roll of each said yarn feed roll assembly being constructed and arranged for rotation about its longitudinal axis independently of the rotation of the other ones of said yarn feed rolls.

11. The yarn feed mechanism of claim 10, the yarn feed roll assemblies of the spaced series of said yarn feed roll assemblies being disposed in series along a line extending upwardly and outwardly away from the frame of the tufting machine.

12. The yarn feed mechanism of claim 10, the yarn feed roll assemblies of the spaced series of said yarn feed roll assemblies being disposed in series along a vertical line extending upwardly away from the frame of the tubing machine.

13. The yarn feed mechanism of claim 10, the yarn feed roll assemblies of the spaced series of said yarn feed roll assemblies being disposed in series along a horizontal line extending away from the frame of the tufting machine.

14. The yarn feed mechanism of claim 10, wherein the yarn feed roll assemblies of the spaced series of said yarn feed roll assemblies are disposed along an arcuate line extending upwardly and outwardly away from the frame of the tufting machine.

15. The yarn feed mechanism of claim 1, wherein said orbital yarn applying member comprises an elongate pinch roller carried by the yarn feed roll assembly spaced from and about said yarn feed roll in said yarn receiving position, said elongate pinch roller being eccentrically orbitable about the yarn feed roll from said yarn receiving position into said yarn applying position in which said pinch roller is moved into engagement with the yarn feed roll to apply the selected yarns against at least a portion of the yarn driving periphery of the yarn feed roll in response thereto, so that the rotation of the yarn feed roll drives the yarn toward the needles of the tufting machine.

16. The yarn feed mechanism of claim 15, said yarn feed roll assembly comprising:

a pair of spaced, opposed, and parallel hubs;

a pair of spaced, opposed, and parallel indexing plates, each said indexing plate being supported on a respective one of said hubs for rotation about the yarn feed roll independently of the rotation of said yarn feed roll;

each said hub having a raised cam formed as a part thereof, each respective indexing plate being received on one of said raised cams, said raised cams having an eccentric cam profile defined thereon;

said pinch roller being supported for rotation at its opposed ends on said pair of indexing plates and being carried on said indexing plates for orbital movement about said axis;

said pinch roller being operably engaged with said eccentric cam profile for moving said pinch roller away from the yarn feed roll in said yarn receiving position and into engagement with the yarn feed roll in said yarn applying position in response to the rotation of said pair of indexing plates about the yarn feed roll.

17. The yarn feed mechanism of claim 16, wherein said indexing plates are fastened to one another for moving together about said axis, said yarn feed mechanism further comprising a locking mechanism for each said indexing plate, each said locking mechanism being constructed and arranged to lock said indexing plates, respectively, at any one of a plurality of rotational positions about said yarn feed roll.

18. The yarn feed mechanism of claim 15, comprising a spaced series of said yarn feed roll assemblies supported for rotation on said framework independently of one another and adjacent the yarn feed path, the yarn feed rolls of each respective one of said yarn feed roll assemblies being constructed and arranged for rotation about their respective longitudinal axis independently of the rotation of the other ones of said yarn feed rolls.

19. The yarn feed mechanism of claim 18, the yarn feed roll assemblies of the spaced series of said yarn feed roll assemblies being disposed in series along a line extending upwardly and outwardly away from the frame of the tufting machine.

20. The yarn feed mechanism of claim 18, wherein said spaced series of yarn feed roll assemblies includes four of said yarn feed roll assemblies.

21. A yarn feed mechanism for use with a tufting machine for producing tufted articles, the tufting machine having a frame, a yarn supply, a needle bar supported on the frame and reciprocated toward and away from a tufting zone underneath the needle bar and through which a backing material is transversely passed, the needle bar having a spaced series of tufting needles aligned thereon and disposed along the length thereof for penetrating the backing material for sewing tufts of yarn therein, and a yarn feed path along which yarns extend from the yarn supply to the respective needles of the tufting machine, said yarn feed mechanism comprising:

(a) a yarn feed mechanism framework for being mounted on the frame of the tufting machine along the yarn feed path;

(b) a spaced series of yarn feed roll assemblies supported for rotation independently of one another on said framework, each respective one of said yarn feed roll assemblies being positioned adjacent the yarn feed path and including:

a rotatable and elongate yarn feed roll extending along a longitudinal axis parallel to the needle bar of the tufting machine, said yarn feed roll having an exterior yarn driving periphery for engaging yarns thereon;

means for rotating said yarn feed roll about said axis in timed relationship with the reciprocation of the needle bar;

at least one elongate yarn control rod removably supported on and orbitally carried by said assembly about said axis, said control rod being spaced from and parallel to said yarn feed roll and being concentrically movable independently of and about said yarn feed roll from a yarn receiving position for receiving an intermediate portion of selected yarns thereon, into a yarn applying position in which the yarn applying member selectively applies the yarns against at least a portion of the yarn driving periphery of the yarn feed roll so that the rotation of the yarn feed roll drives the yarn toward the needles of the tufting machine.

22. The yarn feed mechanism of claim 21, wherein said spaced series of yarn feed roll assemblies are disposed in series along an arcuate line extending upwardly and outwardly away from the frame of the tufting machine.

23. The yarn feed mechanism of claim 21, the yarn feed roll assemblies of the spaced series of said yarn feed roll assemblies being disposed in series along a vertical line extending upwardly away from the frame of the tufting machine.

24. The yarn feed mechanism of claim 21, the yarn feed roll assemblies of the spaced series of said yarn feed roll assemblies being disposed in series along a horizontal line extending away from the frame of the tufting machine.

25. The yarn feed mechanism of claim 21, wherein said spaced series of yarn feed roll assemblies comprises four of said yarn feed roll assemblies.

26. A yarn feed mechanism for use with a tufting machine for producing tufted articles, the tufting machine having a frame, a yarn supply, a needle bar supported on the frame and reciprocated toward and away from a tufting zone underneath the needle bar and through which a backing material is transversely passed, the needle bar having a spaced series of tufting needles aligned thereon and disposed along the length thereof for penetrating the backing material for sewing tufts of yarn therein, and a yarn feed path along which yarns extend from the yarn supply to the respective needles of the tufting machine, said yarn feed mechanism comprising:

(a) a yarn feed mechanism framework for being mounted on the frame of the tufting machine along the yarn feed path;

(b) a yarn feed roll assembly rotatably supported on said framework, said yarn feed roll assembly being positioned adjacent said yarn feed path and having:

a rotatable and elongate yarn feed roll extending along a longitudinal axis parallel to the needle bar of the tufting machine, said yarn feed roll having an exterior yarn driving periphery for engaging yarns thereon;

means for rotating said yarn feed roll about said axis in timed relationship with the reciprocation of the needle bar;

an elongate pinch roller rotatably supported on and orbitally carried by said framework about said feed roll, said pinch roller being spaced from and parallel to said yarn feed roll and being eccentrically movable independently of and about said yarn feed roll from a yarn receiving position in which the pinch roller is spaced from the yarn feed roll for receiving an intermediate portion of selected yarns thereon into a yarn applying position in which the pinch roller is engaged with the periphery of the yarn feed roll and applies the selected yarns against at least a portion of the yarn driving periphery of the yarn feed roll so that the rotation of the yarn feed roll drives the yarns toward the needles of the tufting machine.

27. The yarn feed mechanism of claim 26, further comprising a spaced series of said yarn feed roll assemblies disposed along and adjacent the yarn feed path, each said yarn feed roll assembly being constructed for rotation about their respective yarn feed rolls independently of the other one of said yarn feed roll assemblies, the yarn feed roll of each of said yarn feed roll assemblies being constructed and arranged for rotation about its respective longitudinal axes independently of the rotation of the other ones of said yarn feed rolls.

28. The yarn feed mechanism of claim 27, the yarn feed roll assemblies of the spaced series of said yarn feed roll assemblies being disposed in series along a line extending upwardly and away from the frame of the tufting machine.

29. The yarn feed mechanism of claim 27, the yarn feed roll assemblies of the spaced series of said yarn feed roll assemblies being disposed in series along a vertical line extending upwardly away from the frame of the tufting machine.

30. The yarn feed mechanism of claim 27, the yarn feed roll assemblies of the spaced series of said yarn feed roll assemblies being disposed in series along a horizontal line extending away from the frame of the tufting machine.

* * * * *